United States Patent [19]

Costello et al.

[11] 4,211,493

[45] Jul. 8, 1980

[54] IMPACT PRINTING APPARATUS

[75] Inventors: Matthew J. Costello; Norman K. Gallagher, both of Bethel, Conn.

[73] Assignee: Burroughs Corporation, Detroit, Mich.

[21] Appl. No.: 937,932

[22] Filed: Aug. 30, 1978

[51] Int. Cl.[2] ..... B41J 3/12

[52] U.S. Cl. ..... 400/121; 101/93.04

[58] Field of Search ..... 101/93.04, 93.05, 93.48; 400/121, 124

[56] References Cited

U.S. PATENT DOCUMENTS

| | | | |
|---|---|---|---|
| 2,659,652 | 11/1953 | Thompson | 101/93.04 X |
| 3,971,311 | 7/1976 | Deproux | 101/93.04 |
| 4,022,311 | 5/1977 | Krull | 400/124 X |
| 4,114,532 | 9/1978 | Arzoumanian | 101/93.48 |
| 4,129,390 | 12/1978 | Bigelow et al. | 400/121 |

FOREIGN PATENT DOCUMENTS

| | | | |
|---|---|---|---|
| 967808 | 5/1975 | Canada | 101/93.48 |

*Primary Examiner*—Paul T. Sewell

*Attorney, Agent, or Firm*—Kevin R. Peterson; Robert A. Green; Edward J. Feeney, Jr.

[57] ABSTRACT

The disclosure is of an impact printer assembly for use in facsimile machines or the like comprising a housing which contains a plurality of parallel slidable plates, each of which carries an electrical winding in the form of a coil. Each plate and its coil is disposed between a pair of magnets with the coil in operative relation with the magnets. The magnets are positioned so that a north pole is adjacent to one surface of a plate and a south pole is adjacent to the opposite surface of the plate. Thus, each magnet is in operative relation with two plates except for the first and last magnets of the assembly. The printer assembly includes a plurality of parallel printing plates, each of which has a leading portion which provides the desired impact and a second portion which is in engagement with a plate and is driven thereby when signal current flows through the coil on that plate. When current is supplied to the coil of a plate in the proper direction, the plate is urged in a direction such that the associated printing plate strikes the paper and forms a character. Current flow in the opposite direction reverses the plate and retracts it and the printing plate back to the ready-to-print position.

8 Claims, 7 Drawing Figures

IMPACT PRINTING APPARATUS

BACKGROUND OF THE INVENTION

Matrix-type impact printers of the type contemplated by the present invention are known in the art; however, such printers have the drawback that they are relatively complex and slow in operation. One reason for the lack of speed is that the printers are not positively retracted, but are spring retracted. In addition, optimum design of the printing plates is not achieved. The present invention provides a matrix printer which is relatively simple in construction and is capable of a higher speed of operation than comparable apparatus in the prior art.

DESCRIPTION OF THE PREFERRED EMBODIMENTS

Figure 2:
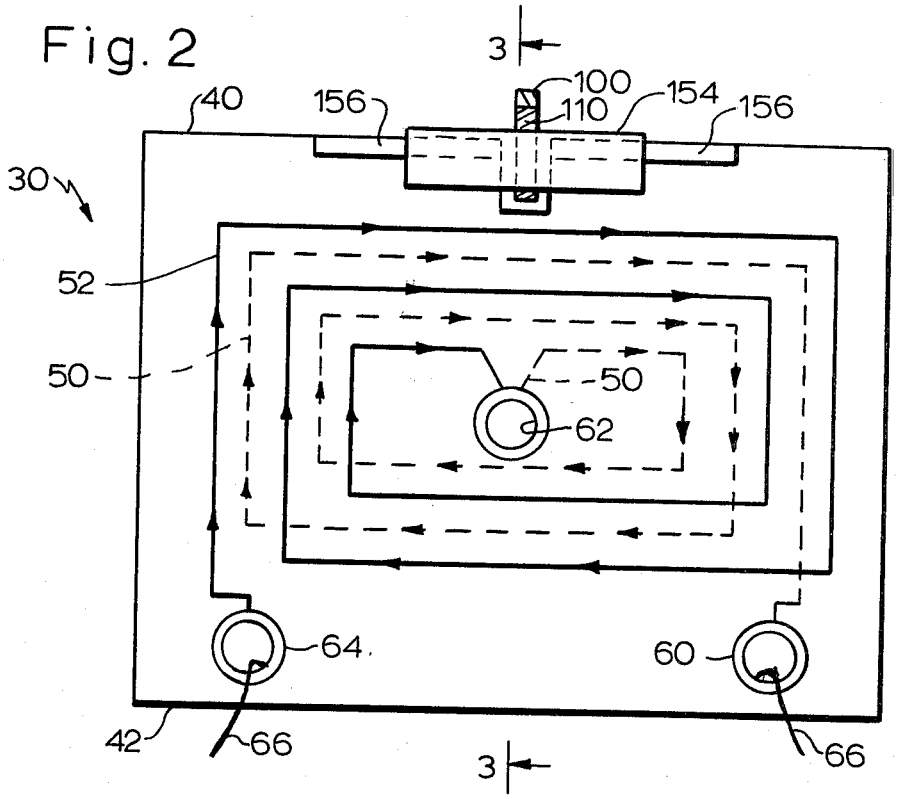
FIG. 2 is a front elevational view of a coil card used in the apparatus of FIG. 1.

An impact printer assembly 10 embodying the invention comprises a housing 20 which carries a plurality of printing coil cards 30, preferably seven, for printing characters using a 5×7 dot matrix. The coil cards 30 comprise thin insulating plates, for example, of a material like that used in making printed circuit boards, and each coil card has left and right large-area surfaces 32 and 34 and upper and lower edges 40 and 42 (FIG. 2). A conductive coil 50 is formed on surface 32, and a coil 52 is formed on surface 34. Coil 50 originates at a plated hole 60 (FIG. 2) at the lower edge of the card and is wound on the surface 32 of the card until it reaches a plated hole 62 at the center of the card where it connects to one end of the coil 52. Coil 52 is wound on surface 34, and it terminates at a plated hole 64 at the lower edge of the card. Conductors or wires 66 are secured to the plated holes 60 and 64 and are used to connect the coils to external circuitry.

The conductive coils 50 and 52 are wound so that current flows in the same direction in the horizontal wires above and below the horizontal axis of the card. This is illustrated by the arrows in FIG. 2. With this arrangement, the desired movement of a card 30 is achieved when current flows through the coils in the proper direction, as described below. Current flow in the vertical conductors at the sides of each card balance one another and produce zero force.

For economy in manufacturing the coil cards, the art work for each side of the card may be exactly the same; the conductors 50 and 52 need not be offset as shown in the drawing.

The upper edge 40 of each card is provided with a slot or notch 44 for a purpose to be described.

Figure 4:
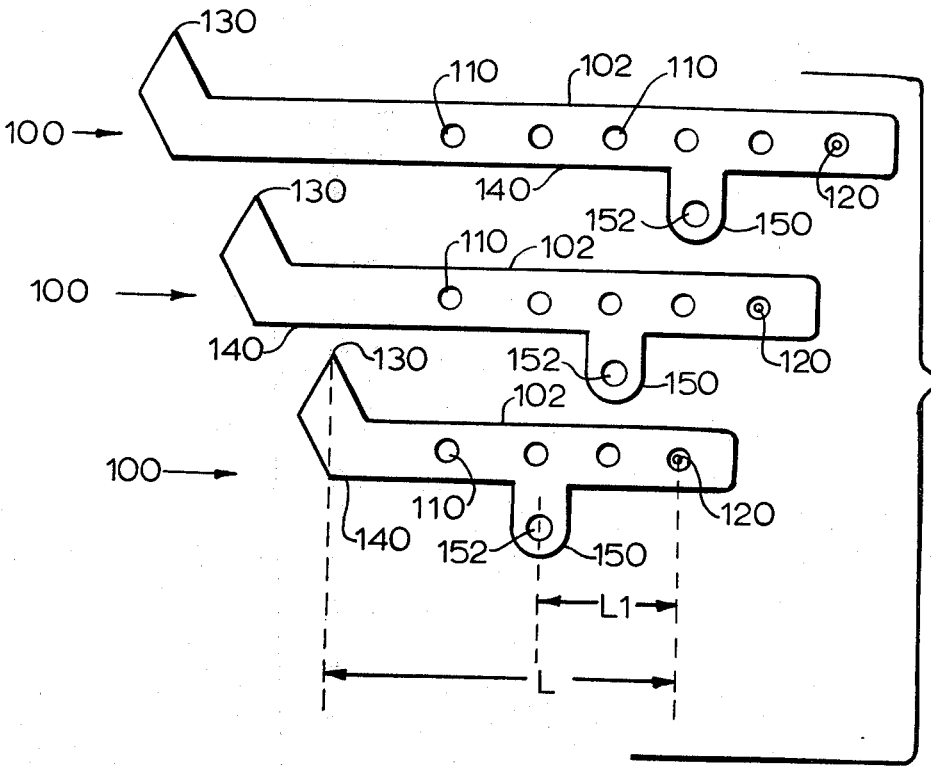
FIG. 4 is a front elevational view of several of the printing plates of FIG. 1 illustrating one aspect of their operation.
Figure 5:
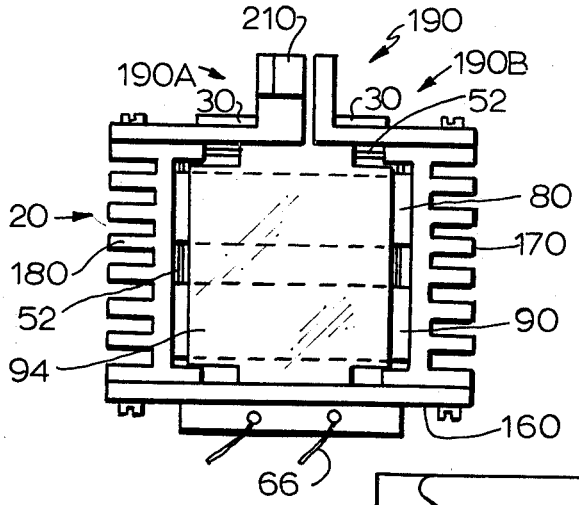
FIG. 5 is a side elevational view of a complete assembly including the apparatus of FIG. 1.
Figure 6:
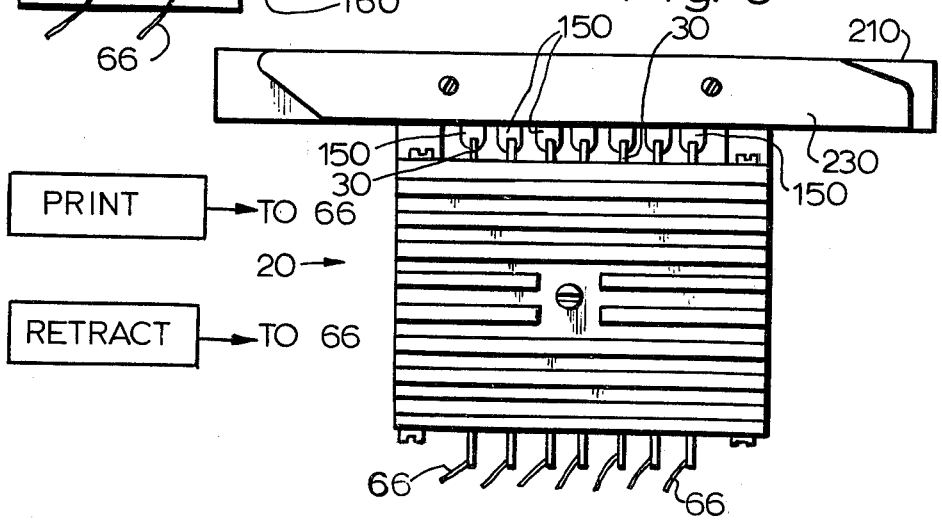
FIG. 6 is a front elevational view of the apparatus of FIG. 5.
Figure 7:
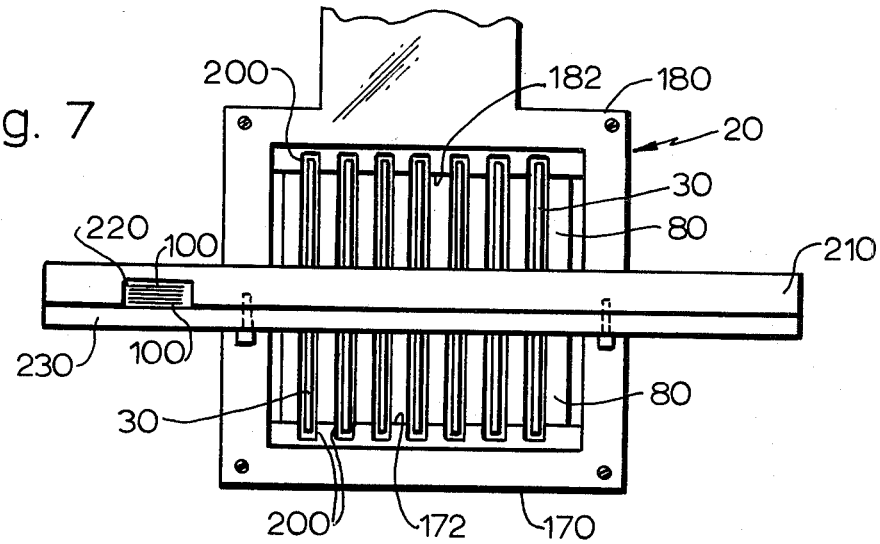
FIG. 7 is a plan view of the apparatus of FIG. 5.

A plurality of metal impact printing plates 100, one for each card 30, are disposed in a stack, transverse to the stack of coil cards. Each printing plate is very thin and has an elongated main body portion 102 which is provided with a plurality of apertures 110, by means of which the plate is threaded on and held in place by posts 120 provided on the housing. One end of each printing plate curves upwardly to a point 130 which does the impact printing, and the opposite end is threaded on a post 120 which acts as a pivot point. Each plate is provided, along its lower edge 140, with an apertured tab or hammer 150. FIG. 4 shows several printing plates.

Figure 3:
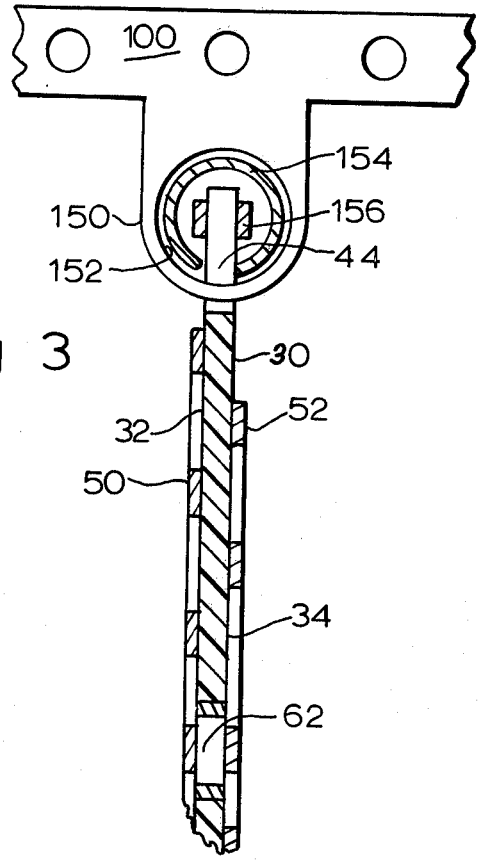
FIG. 3 is a sectional view along the lines 3—3 in FIG. 2.

Referring to FIGS. 2 and 3, the hammer 150 of the printing plate 100 is positioned in the slot 44 in a coil card 30, and a roll pin 154 is slipped over the top edge of the card and into the aperture 152 in the hammer. Conductors 156 provided along the upper edges of the card lie within the diameter of the roll pin and prevent the roll pin from slipping off the card once it is set in place.

The diameters of the mounting apertures 110 of the printing plates on posts 120, except for the rightmost pivot aperture, are large enough so that the printing plates can pivot sufficiently about their pivot pins 120 to permit the printing points 130 to strike the paper.

The printing plates are positioned and dimensioned, as shown in FIG. 4, so that the length of the plate from the hammer to its pivot point is one-third of its total length. With this arrangement, each printing plate moves the same distance in performing a printing operation.

The coil cards 30 are disposed in a stack, parallel to each other and slidably supported in housing 20. Each coil card 30 is positioned between a first set of aligned upper permanent magnets 80, positioned with the north pole of one magnet being adjacent to the south pole of the adjacent magnet with a card 30 between them. A second set of aligned lower magnets 90 is disposed on either side of each card, with the poles oriented oppositely to those of the first set of magnets. The magnets 80 and 90 are suitably positioned with respect to the cards 30 so that, when current is passed through the coils of a card, as dictated by the right hand rule in electricity, the card and its associated impact printing plate 100 is driven upwardly and the point 130 of the printing plate strikes a paper and makes a visible dot thereon. When the current is reversed, the printing plate is positively retracted.

In one arrangement, the magnets 80 are in contact with the coil cards 30, with a thin sheet 92 of an insulating material interposed for electrical insulating purposes.

Figure 1:
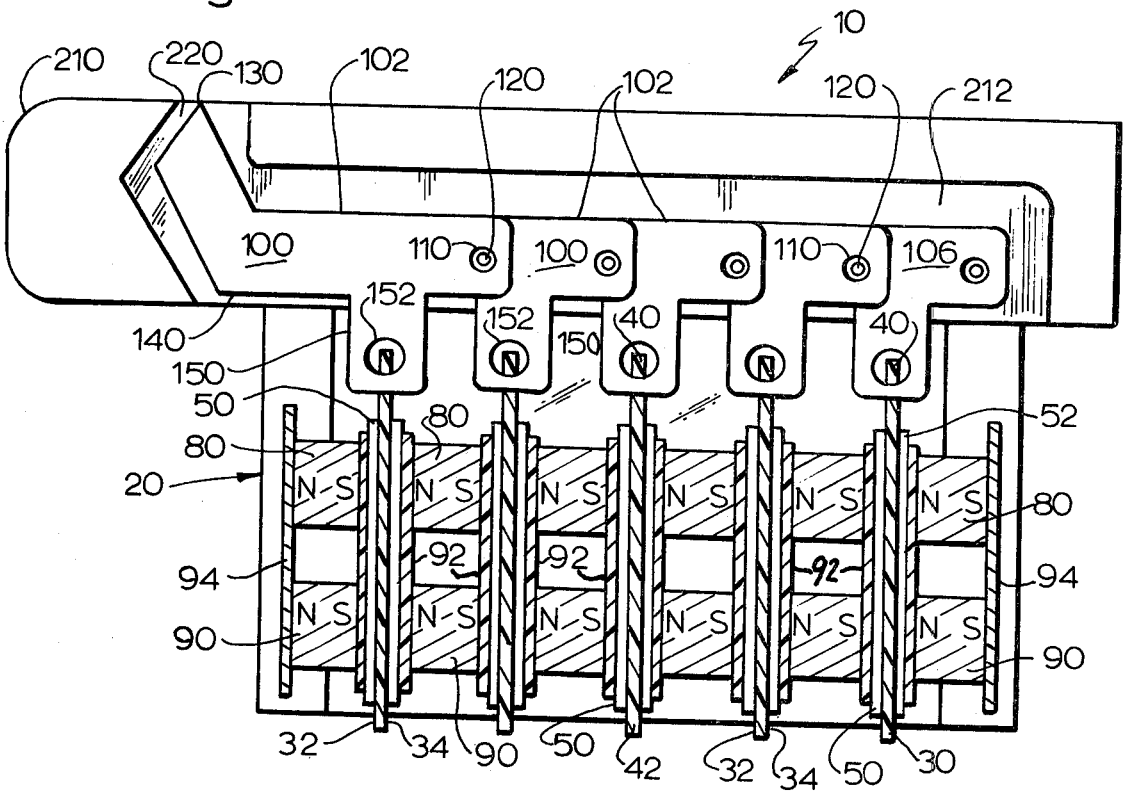
FIG. 1 is a front elevational view of a portion of the apparatus of the invention.

Magnetic shorting plates 94 are disposed in contact with the magnets 80 and 90 at the left and right hand ends of the assembly, as seen in FIG. 1, to control the magnetic flux pattern.

The housing 20 has suitable slots and channels for supporting the magnets 80 and 90 and the shorting plates 94.

One suitable housing 20 for the coil cards 30, shown in FIGS. 1 and 5–7, comprises a frame including a bottom ring 160, front plate 170 and rear plate 180, and a two-part top ring 190. The front and rear plates include inner surfaces 172 and 182, respectively, which have slots 200 which receive the front and rear edges of the coil cards 30 and similar slots which receive the front and rear ends of the magnets 80 and 90. The top and bottom rings are secured to the front and rear plates by screws or the like to form a rigid assembly. The top frame is made in two parts 190A and 190B, with the rear portion 190B provided with a transverse plate 210 which extends vertically therefrom. The front surface of the plate 210 is provided with a depression or recess 212 (FIG. 1) which carries the posts 120 on which the printing plates 100 are threaded, the printing plates being seated in the depression. The top surface of the plate is provided with an aperture 220 which communicates with the recess 212 and which is aligned with the points 130 of the plates, the points projecting through the aperture when their associated coil cards are energized. The other half 290A of the top ring includes a plate 230, similar to plate 210, which covers the recess 212 and the printing plates 100 and is secured to the plate 210 by screws or the like.

What is claimed is:

1. Impact printing apparatus comprising a plurality of insulating cards disposed parallel to each other in an array, electromagnetic means coupled to each card for use in driving the cards individually into and out of printing position, and a plurality of thin printing plates disposed parallel to each other and transverse to said cards, each plate being secured to one of said cards whereby each card can drive its printing plate to perform a printing operation, each printing plate including an elongated portion having a printing means at one end and a pivot point at the opposite end, the printing plate also including a hammer portion which extends from the elongated portion and is secured to its card so that the plate can be driven by the card.

2. The apparatus defined in claim 1 wherein the electromagnetic means includes an electrical winding on each card and two spaced-apart permanent magnets positioned between adjacent cards, the magnets being positioned with like poles being oriented above and below each other and different poles being on opposite sides of each card.

3. The apparatus defined in claim 1 wherein the pivot points of said printing plates are spaced apart along a line which is generally parallel to the array of cards.

4. The apparatus defined in claim 1 wherein the elongated portion of each printing plate includes a plurality of apertures through which support pins can be inserted.

5. The apparatus defined in claim 2 and including magnetic shorting bars in contact with the magnets disposed at the opposite ends of the array of cards.

6. Impact printing apparatus comprising a plurality of insulating cards disposed parallel to each other in an array, electromagnetic means coupled to each card for use in driving the cards individually into and out of printing position, and a plurality of thin printing plates disposed parallel to each other and transverse to said cards, each plate being secured to one of said cards whereby each card can drive its printing plate to perform a printing operation, each printing plate including an elongated portion having a printing means at one end and a pivot point at the opposite end, the printing plate also including a hammer portion which extends from the elongated portion and is secured to its card so that the plate can be driven by the card, the distance from the hammer to the pivot point of all of said printing plates being substantially the same.

7. Impact printing apparatus comprising a plurality of generally rectangular insulating cards disposed in a stack parallel to each other, the cards each having an upper edge and a lower edge, the upper and lower edges being aligned with each other along the stack, electromagnetic means coupled to each card for driving the cards individually into and out of printing position, and a plurality of printing plates disposed in a stack parallel to each other adjacent to the upper edges of the cards, the printing plates being oriented transverse to said cards, each printing plate being coupled to a card so it can be driven by its card into and out of printing position, each printing plate including an elongated portion having a printing means at one end and a pivot point at the opposite end, the printing plate also including a hammer portion which extends from the elongated portion and is secured to its card so that the plate can be driven by the card.

8. Impact printing apparatus comprising a plurality of generally rectangular insulating cards disposed in a stack parallel to each other, the cards each having an upper edge and a lower edge, the upper and lower edges being aligned with each other along the stack, electromagnetic means coupled to each card for driving the cards individually into and out of printing position, and a plurality of printing plates disposed in a stack parallel to each other adjacent to the upper edges of the cards, the printing plates being oriented transverse to said cards, each printing plate being coupled to a card so it can be driven by its card into and out of printing position, each printing plate including an elongated portion having a printing means at one end and a pivot point at the opposite end, the printing plate also including a hammer portion which extends from the elongated portion and is secured to its card so that the plate can be driven by the card, the distance from the hammer to the pivot point of all of the printing plates being substantially the same.

* * * * *